US007755561B2

(12) United States Patent
Slattery

(10) Patent No.: US 7,755,561 B2
(45) Date of Patent: Jul. 13, 2010

(54) ANTENNA CONCEALMENT ASSEMBLY

(75) Inventor: Michael Patrick Slattery, Colorado Springs, CO (US)

(73) Assignee: ConcealFab Corporation, Colorado Springs, CO (US)

( * ) Notice: Subject to any disclaimer, the term of this patent is extended or adjusted under 35 U.S.C. 154(b) by 732 days.

(21) Appl. No.: 11/687,469

(22) Filed: Mar. 16, 2007

(65) Prior Publication Data

US 2007/0216599 A1 Sep. 20, 2007

Related U.S. Application Data

(60) Provisional application No. 60/783,654, filed on Mar. 17, 2006.

(51) Int. Cl.
*H01Q 1/42* (2006.01)

(52) U.S. Cl. ..... 343/872; 343/878; 343/880

(58) Field of Classification Search ..... 343/872, 343/878, 890

See application file for complete search history.

(56) References Cited

U.S. PATENT DOCUMENTS

| | | | | |
|---|---|---|---|---|
| 5,111,207 | A | 5/1992 | Allen | |
| 5,375,353 | A | 12/1994 | Hulse | |
| 5,787,649 | A | 8/1998 | Popowych et al. | |
| 5,852,424 | A | 12/1998 | Reineck et al. | |
| 6,122,866 | A | 9/2000 | Thomas et al. | |
| 6,222,503 | B1 | 4/2001 | Gietema et al. | |
| 6,456,255 | B1 | 9/2002 | Lundahl | |
| 2003/0006939 | A1* | 1/2003 | Drews et al. | 343/880 |
| 2003/0016183 | A1 | 1/2003 | Pyanowski et al. | |
| 2003/0117337 | A1 | 6/2003 | Lendriet | |
| 2003/0144821 | A1 | 7/2003 | Lendriet | |
| 2004/0080461 | A1 | 4/2004 | Rothgeb et al. | |
| 2004/0233120 | A1* | 11/2004 | Ryan | 343/878 |
| 2005/0195122 | A1* | 9/2005 | Zaretsky et al. | 343/872 |

* cited by examiner

*Primary Examiner*—Douglas W Owens
*Assistant Examiner*—Dieu Hien T Duong
(74) *Attorney, Agent, or Firm*—Michael C. Martensen; Hogan Lovells US LLP

(57) ABSTRACT

A rigid antenna support structure is designed and prefabricated to rest on two or more existing support foots normally found on a roof or similar structure. The antenna support structure, to which antennas are attached, possess mounting brackets associated with the exterior of the structure configured to accept a plurality of vertical support members composed of a substantially RF transparent material. Attached to the vertical support members are a number of horizontal support members thereafter forming a concealment assembly skeleton. A plurality of RF transparent panels are then connected to the horizontal support members so as to form a concealment assembly that conceals the antenna support structure and antennas. The concealment assembly is environmentally and aesthetically pleasing, and retains RF transparency so as to not to attenuate the RF signals being sent to or originating from the antennas housed within.

27 Claims, 3 Drawing Sheets

ANTENNA CONCEALMENT ASSEMBLY

RELATED APPLICATIONS

This application claims the benefit of U.S. Provisional Application No. 60/783,654 filed Mar. 17, 2006.

BACKGROUND OF THE INVENTION

1. Field of the Invention

The present invention relates, in general, to RADIO Frequency ("RF") transparent structures and particularly to RF transparent wall structures comprising polyvinyl chloride ("PVC") material formed to visually conceal high frequency and broadband antennas and other RF sensitive devices.

2. Relevant Background

High-speed wireless broadband networks and the like continue to grow in popularity and versatility. Consumer interest in such technology has fueled a need to provide uninterrupted service throughout many regions of the United States. Typically wireless services are limited to a relatively short line of sight range from a local antenna, thus the increased demand has fostered a corresponding demand in establishing numerous antenna structures capable of supporting such RF technology. While the demand for such service continues to grow, the tolerance of unsightly antenna structures associated with such a service has been less than forthcoming. To achieve seamless service in many areas, concealed antenna assemblies are placed on rooftops and other structures throughout the United States and other countries. Recent industry consolidation and government bandwidth auctions has limited the number of licensed carriers to a handful of companies, yet their need for local rooftop antennas continues to grow at an exponential rate. These mega-carriers as they are now referred, have recently entered thousands of US cities and rural areas to expand their cellular, broadband and new $4^{th}$ generation wireless technology networks.

While the wireless industry expands and upgrades existing networks with new site locations, local Township, City and County municipalities serving these communities are becoming tougher on antenna concealment codes and regulations that prohibit antennas from being mounted on buildings and rooftops without a concealment plan that will blend the resulting structure into the environment.

Concealment of antenna structures is typically done to protect the antenna elements from weather or other harsh environments and/or to meet regulatory requirements. In some applications such as the military, antenna structures and the antennas themselves were camouflaged to reduce the likelihood of detection and destruction. While concealment of cellular and other wireless antenna in a civil setting must meet local environmental constraints, the provider of the cellular service faces economic tradeoffs between aesthetically concealing the antennas so as to meet local ordinances and codes while minimizing the detrimental effects of the concealment assembly on signal strength and the functionality of the antenna.

Prior antenna concealment assemblies have generally been customized structures typically composed of Fiberglass, Fiberglass Reinforced Plastic ("FRP"), Polyurethane Foam, ABS Plastic and/or other composite material. Them materials have offered a reasonable degree of structural integrity and strength as well as reasonable degree of RF transparency for lower frequency cellular applications. Such customized structures and material choices, when implemented on a pervasive scale, are however, less feasible for higher spectrum broadband and satellite applications due to extreme RF transparency requirements.

Architectural and engineering firms typically design custom wireless rooftop sites using steel or similar metallic substances for mating with ballasted frames or structural roof connections from the building. From these connections a frame is constructed to house various antennas. A custom concealment assembly's frame and skin are normally thereafter attached to this steel antenna frame to conceal the antennas. As mentioned, the structure of these existing concealment products, such as the skeleton and external panels, are typically concealed with relatively thick fiberglass or FRP sheathing products.

As demand for cellular and wireless capability continues to grow, so to does the need to install and conceal additional cellular and wireless antennas. A need exists, therefore, to conceal these antennas with a standardized and cost effective concealment assembly that is both economical to produce and install as well as ultra transparent to higher RF used for data rich transmissions . These and other problems recognized in the prior art are addressed by the present invention.

SUMMARY OF THE INVENTION

Briefly stated, the present invention involves systems and methods for concealing wireless antenna while maintaining RF transparency using ultra-thin materials. The present invention uses a combination of maintenance-free, RF transparent, and structurally rigid prefabricated Polyvinyl Chloride (PVC) members to conceal an antenna structure. A rigid antenna support structure is designed and fabricated to rest on an existing ballasted antenna frame or on two or more existing support foots normally found on a roof or similar structure. The existing antenna support structure, to which the antennas are attached, possess mounting brackets or other direct points of attachment associated with the exterior of the structure configured to accept a plurality of vertical prefabricated support members composed of a substantially RF transparent material.

Attached to the vertical support members are a number of substantially RF transparent horizontal support members forming a concealment assembly skeleton. This skeleton, which is attached to the antenna support structure, is, in one embodiment, constructed from hollow PVC extruded material and is prefabricated based on a predetermined design of the antenna support structure for quick and economical on-site assembly.

A plurality of RF transparent interlocking PVC panels are connected to the horizontal support members so as to form a wall concealment assembly that conceals the antenna support structure and antennas housed within. The resulting assembly is environmentally and aesthetically pleasing and retains RF transparency so as to not to attenuate the signals being sent to, or originating from, the antennas.

Additional advantages of the present invention will be set forth in the description which follows and will be obvious from the description, or may be learned by practice of the invention. The advantage of the invention will be realized and attained by means of the elements and combinations particularly pointed out in the appended claims.

It is to be understood that both the foregoing general description and the following detailed description are exemplary and explanatory only and are not restrictive to the invention, as claimed.

BRIEF DESCRIPTION OF THE DRAWINGS

The aforementioned and other features and objects of the present invention and the manner of attaining them will become more apparent and the invention itself will be best understood by reference to the following description of a preferred embodiment taken in conjunction with the accompanying drawings, wherein.

The Figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF THE PREFERRED EMBODIMENTS

Exemplary embodiments of systems and methods for concealing RF antennas with RF transparent material, as are illustrated in the accompanying drawings, are hereinafter presented. Consistent with the general principles of the present invention, an antenna concealment assembly 100 is presented that conceals one or more RF antennas with an assembly composed of RF transparent material.

Figure 1:
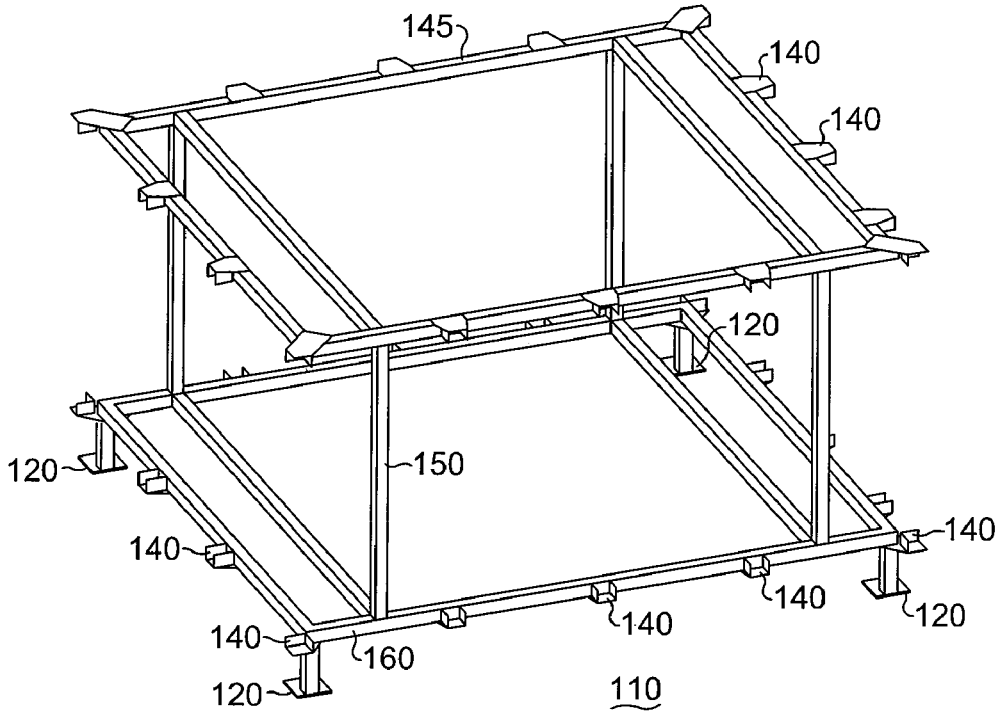
FIG. 1 shows a perspective view of a cellular antenna support structure possessing mounting fixtures for a prefabricated concealment assembly according to one embodiment of the present invention.

FIG. 1 shows a perspective view of a wireless antenna support structure 110 possessing mounting fixtures for a prefabricated concealment assembly according to one embodiment of the present invention. As can be appreciated by one skilled in the relevant art, most building roofs are either flat or gabled. A cellular or wireless antenna support structure 110, as shown in FIG. 1, provides a means by which the support structure can be attached to existing roof support points capable of structurally supporting the antenna and concealment assembly. These structural attach points vary depending on the particular environment, roof, or building on which the antenna support structure 110 is installed. The building's roof design and the size and weight of the steel antenna frame, with attached concealment members and panels, will dictate if a ballasted or roof mounted product is possible. In most cases, the requirement will be for the frame and concealment assembly to be structurally mounted directly to the building's roof. In other embodiments, and without departing from the scope of the invention, the antenna support structure can be attached to a supporting structure separate or independent of a building or roof.

As shown in FIG. 1, the antenna support structure 110 includes both horizontal and vertical members as required to support the antennas begin housed within the structure. In the embodiment depicted in FIG. 1, a rectangular structure possessing four attachment points 120 for attaching the antenna support structure 110 to the underlying structural building are evident. According to one embodiment of the present invention, the antenna support structure includes an inner and outer support ring. The inner support ring or structure is associated with the housing and mounting of the antennas. In the embodiment shown in FIG. 1, two opposing inner support structures are provided for housing and attaching various antenna. The outer support ring is configured to allow the transmitting side of the antenna to face outward from the inner ring and yet be concealed by the concealment assembly 160 attached to the outer ring. Associated with the outer support ring are upper and lower cross members 145 that house a plurality of mounting platforms 140. The mounting platforms 140 are, in one embodiment of the present invention, oriented along the horizontal members of the antenna support structure 110 that comprise the outer ring. In other embodiments, the support structure may be of other shapes such as cylindrical or triangular based on the underlying antenna configuration.

As shown in FIG. 1, mounting platforms 140 are positioned on horizontal cross members 145 of the external antenna support structural 110 ring in a manner to accept vertical support members of the concealment assembly 100 as will be subsequently described.

In one embodiment of the present invention, an adjustable square, tubular steel frame 160 comprising four or more structural roof attachment points 120 is prefabricated so as to allow the structure's 110 steel frame and attachment points 120 be adjusted in advance or in the field for a structural connection. Above those points, the remaining components of the antenna support structure 110 and concealment assembly 100 are interchangeable and independent of the roof's contact points.

Figure 2:
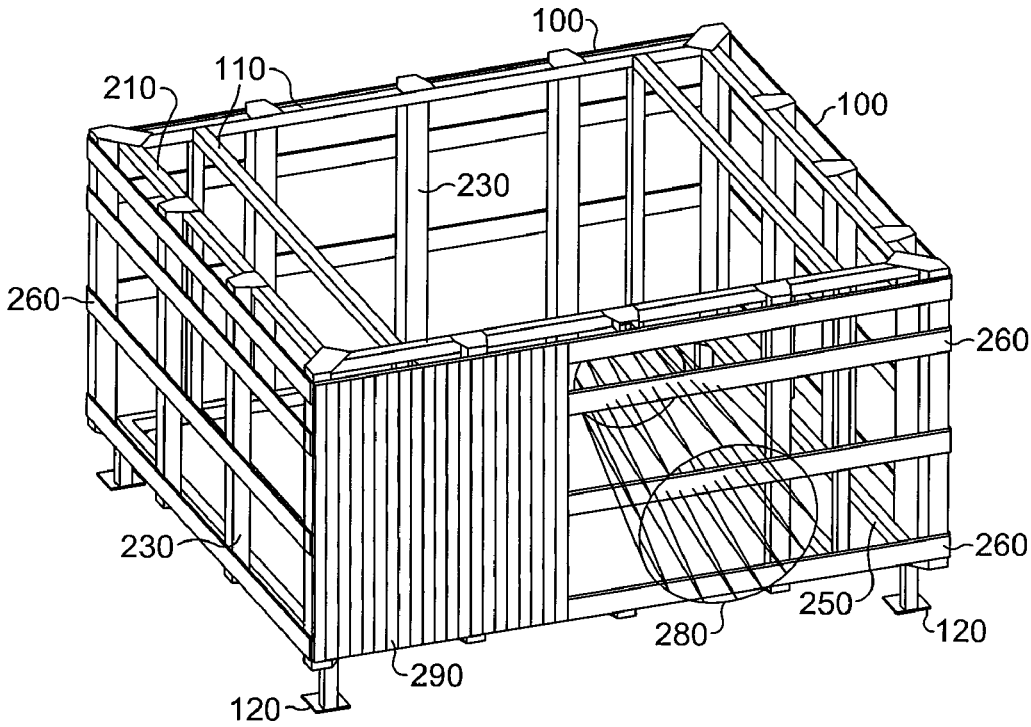
FIG. 2 shows a perspective view of the cellular antenna support structure for a prefabricated concealment assembly showing one orientation of antenna components in comparison to vertical support members of the concealment assembly according to one embodiment of the present invention.

Once the roof frame measurements have been determined and the antenna support structure 110 roof attachment points 120 are adjusted accordingly, additional vertical connection members 150 and corresponding cross members 145 can be constructed. The mounting platforms 140 can thereafter be attached to the upper and lower cross members 145 as required for each individual configuration. In one embodiment of the present invention, and as shown in FIG. 2, the various mounting platforms 145 include both corner mounting platforms and mid-member mounting platforms. The mounting platforms are spaced along the cross members 145 as required to provide adequate structural support for the concealment assembly 100.

The present invention's pre-engineered and prefabricated concealment assembly is independent of the variable steel roof mount dimensions from individual sites, and therefore can be produced with greater efficiencies with maintenance free, UV protected materials. These materials can be produced in multiple colors as well as optional faux stone or brick digital wallpaper coverings to match existing buildings. The present invention can be shipped to the site as individual wrapped pieces as a knock-down kit with assembly instructions, or it can be fully assembled at the fabrication factory and shipped to the cellular construction site as a completed unit ready to be hoisted and attached to the roof mounts. Because the antenna support structure 110 can be adjustable, the on-center distance between each vertical support 150 is determined by the design and specifications of the antenna concealment assembly 100, not by a roof's variable connection points.

FIG. 2 shows a perspective view of a cellular antenna support structure 110 for a prefabricated concealment assembly 100 showing one orientation of antenna components in comparison to vertical support members 230 of the concealment assembly 100 according to one embodiment of the present invention. As previously mentioned, the antenna support structure 110 possesses an internal ring or structure configured to house the antenna and an external structure configured to house the concealment assembly. While in ideal conditions the antenna support structure 110 would also be composed of RF transparent material, the orientation of each antenna mitigates the impact of any interference caused by the antenna support structure 110 while maximizing the importance of the RF transparency of the concealment assembly 100.

FIG. 2 further depicts, according to one embodiment of the present invention, a plurality of vertical support members 230 fixed to various mounting platforms 140. Each vertical support member 230 is accepted into a mounting bracket of an upper and lower mounting platform 210, 250. Once received by the mounting platform 210, 250, the vertical support member 230 is fixed to the platform using a RF transparent fastener. The vertical support members 230 are positioned along the antenna support structure 110 as necessary to bear the weight of the concealment assembly 100. In one embodiment of the present invention, each vertical support member 230 is composed substantially of hollow PVC material with walls of the vertical support member ranging between 0.120 and 0.270 inches in thickness. PVC possesses the inherent qualities of being substantially RF transparent in the 3 kHz to the 300 GHz range while providing adequate structural strength to support the concealment assembly. Furthermore, the well established manufacturing process of PVC products enable components such as the vertical support member 230 be to economically produced.

As shown in FIG. 2 and according to yet another embodiment of the present invention, horizontal support members 260 are attached to the vertical support members 130 to produce several concealment assembly cross members. As with the vertical support members 230, the horizontal support members 260 are composed of a material that is substantially RF transparent. In one embodiment of the present invention, the horizontal cross members 260 are fashioned out of hollow extruded PVC possessing a wall thickness between 0.080 and 0.095 inches. As will be appreciated by one skilled in the art, other material that is substantially RF transparent and offers adequate rigidity and strength to support a concealment assembly is within the scope of, and is indeed contemplated by, the present invention. The present invention's RF transparent PVC members and panels have a dielectric constant in the range of 2.0 to 3.0. This dielectric constant is very comparable to the fiberglass products used today in customized antenna concealment structures. However, the fiberglass materials, due to their lower overall rigidity and strength, are generally engineered to be much denser and thicker than the present invention's PVC members and panels. Therefore the present invention provides a significant decrease in RF loss or attenuation over materials and designs of the prior art. It is also to be understood that although the invention has been described and illustrated with a certain degree of particularity, the present disclosure is made only by way of example, and that numerous changes in the combination, composition, and arrangement of parts can be resorted to by those skilled in the art without departing from the spirit and scope of the invention.

As is further illustrated in FIG. 2, the horizontal support members 260 and vertical support members can be positioned so as to minimize the volume (total thickness) of concealment material (structure) through which the transmission cone 280 must pass. The positioning of the structure is based on projected wind and other structural loads and the inherent strength of the vertical and horizontal support members combined with the rigidity of the concealment panel 290 which complete the concealment.

The concealment panels 290 are, in this embodiment of the present invention, prefabricated and interlocking to match the outside dimensions of the antenna support structure 110 with the vertical support members 230 and the horizontal support members 260 in place. Accordingly, once the initial dimensions of the attaching points 120 of the antenna support structure 110 are known, the remaining components of the antenna concealment assembly 100, and for that matter the antenna support structure 110, can be prefabricated offsite and mounted on the attachment points 120 quickly and with minimal, if any, customization.

Each concealment panel 290 is composed of a material that is substantially RF transparent such as PVC with a thickness of substantially between 0.025 and 0.050 mm. Based on the positioning of the vertical and horizontal support members 230, 290, the concealment panel can be prefabricated to possesses structural channel to enhance rigidity without significantly impacting its RF transparency. In addition, each panel can be fabricated to provide an exterior appearance consistent with the surrounding environment. For example, the exterior surface of the panels 290 can resemble a brick facade or be fashioned to resemble wood siding. Indeed in one embodiment of the present invention, concealment panels are corrugated to aid in flexibility as well as ventilated to mitigate aerodynamic forces imposed on the antenna concealment assembly 100 due to wind forces. In an exemplary embodiment of the present invention, the concealment panels 290 are connected to the horizontal support members 260 using a plurality of RF transparent clasps. The clasps are used to connect the panels 290 using predrilled holes that align with receiving holes in the horizontal support members 260. In yet another embodiment of the present invention, the clasps used to connect the panels 290 to the horizontal support member 260 are of a self-locking nature that allow for quick and permanent coupling of each panel 290 to the corresponding horizontal support member 260.

Figure 3A:
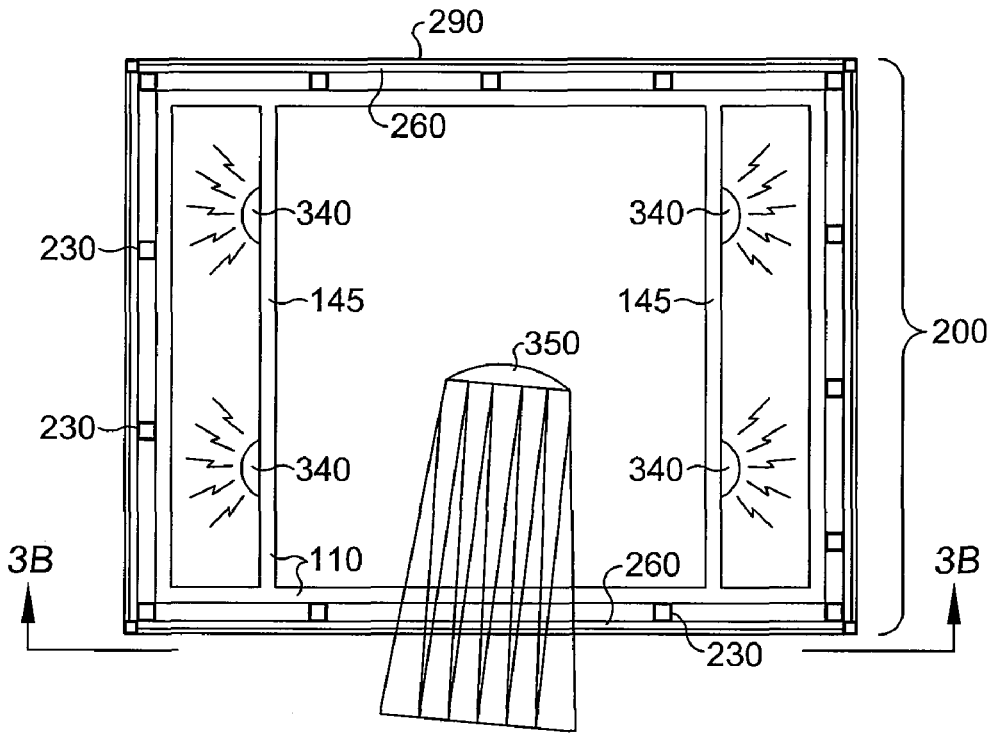
FIG. 3 shows a side and top view of a cellular antenna concealment assembly 100 according to one embodiment of the present invention.
Figure 3B:
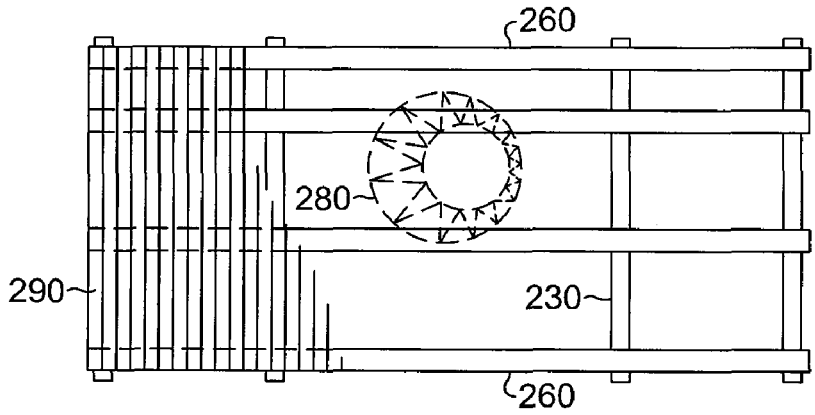

FIG. 3 shows, according to one embodiment of the present invention, a top and side view of an antenna support structure 110 possessing a concealment assembly 100 attached to the structure's exterior. The top view of the concealment assembly 100 shows the antenna support structure 110 to the interior of the concealment assembly 100. Vertical support members 230 are attached to the outside of the antenna support structure 100, so as not to interfere with the positioning and orientation of the antenna 340 mounted on the interior portions of the antenna support structure 110. In the embodiment shown in FIG. 3, two sets of two antenna 340 are positioned spanning between an upper and lower inner cross members 145. The antenna 340 are respectively oriented outward away from the inner antenna support structure 110 and toward the concealment assembly 100. The orientation of these antenna 340 serve to illustrate the need to ensure that the concealment assembly 100 is composed of a material that is substantially RF transparent. Furthermore, a centralized antenna 350 is directed toward a wall designed to minimize structural component interference. Connected to the outside of the vertical support members 230 are the horizontal support members 230 and the concealment panels 290.

The side view of the concealment assembly 100, also shown in FIG. 3, shows one embodiment of a configuration of vertical and horizontal support members 230, 260 that are used to ultimately house the concealment panels 290. The fence-like structure is fashioned based on a particular application. Those applications or concealment projects likely to be placed in an environment subject to severe environmental conditions may necessitate a stronger structure. The number and spacing of the vertical and horizontal support members 230, 260 can be varied depending on individual applications balanced with the need for RF transparency.

Figure 4A:
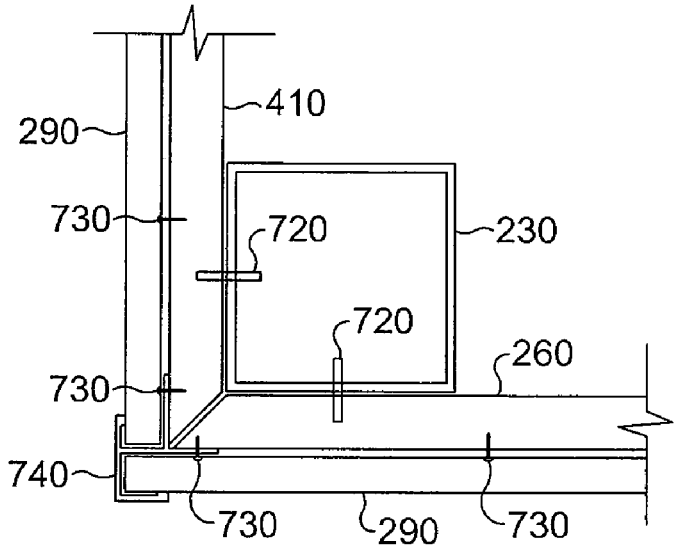
FIG. 4 shows side and top view of the joining and attaching mechanisms and orientation of support members of a prefabricated concealment assembly according to one embodiment of the present invention.
Figure 4B:
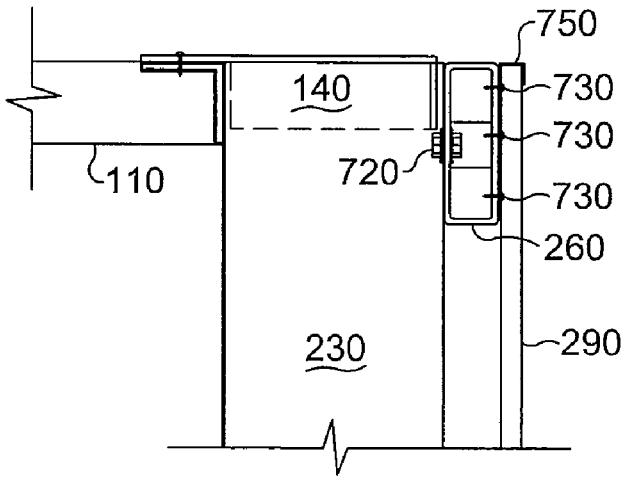

FIG. 4 shows a top and side view of one embodiment of components of the concealment assembly 100 in a final assembled configuration. Looking first at the side view, a mounting platform 140 coupled to the antenna support structure 110 houses the top end of a vertical support member 230. The vertical support member 230 is joined to a horizontal support member 260 via a RF transparent fastener 720. In one embodiment of the present invention, portions of the vertical support member 230 and/or the horizontal support member 260 are removed to provide access to prefabricated openings used in conjunction with the appropriate fasteners 720. Attached to the horizontal support members 260 via RF transparent clasps 730, or other fastening means, are RF transparent panels 290. Again, the openings used to accept the various clasps 730 and fasteners 720 are prefabricated to facilitate quick and economical on-site construction. Also shown in FIG. 4, and according to another embodiment of the present invention, is an overhanging J-channel 740 that affixes to the horizontal support member 260 and allows the RF transparent panel 290 to be inserted and coupled to the horizontal support member without necessitating any type of clasp or fastening device.

The top view of a final assembly of components of the concealment assembly 100 provides additional insight as to the construction and design of one embodiment of the present invention. This top view shows a corner of a concealment assembly 100 having a vertical support member 230 joined to two horizontal support members 410 to which two RF transparent panels 290 are attached. Significantly, this depiction shows that in one exemplary embodiment of the present invention, the vertical support members 230 are hollow columns. FIG. 4 depicts the vertical support member 230 as a square column with a void central region. This type of hollow construction increases rigidity and strength of the member while preserving a low overall material density. Material density is directly related to RF transparency and thus a design using hollow structural members is a significant advantage of the present invention.

As shown in FIG. 4, two horizontal support members 260, also possessing a central region void of material, are joined to the vertical support member 230 using RF transparent fasteners 720. RF transparent panels 290 are thereafter attached to the horizontal support members 260 forming the concealment assembly 100. The embodiment shown in FIG. 4 depicts a mitered corner whereby the two horizontal support members 260 are joined. The RF transparent panels 290 coupled to each horizontal support member 260 forming an overlapping corner configuration. In this embodiment, an RF transparent trim or cap such as J-channel 740 is used to frame and capture the panels 290 along the concealment assembly's edges to provide a finished, maintenance-free appearance.

The entire assembly comprising the vertical support members 230, the horizontal support members 260, the RF transparent panels 290, and the RF transparent fasteners provide a structurally sound concealment of RF antenna while minimizing the material density and thus the interference associated by such a concealment assembly. By using components composed substantially of PVC, the overall RF transparency of the concealment assembly 100, especially high component in regions of the assembly such as corners, is considerably below that of concealment assemblies known in the prior art.

As was previously suggested, the assembly and creation of the concealment assembly 100 is efficient and economical. As a detailed illustration of this process, the following step-by-step process is provided to aid the reader in gaining a full understanding of the scope of the present invention.

Once the antenna support structure 110 is erected on the site, or, alternatively, the exact dimensions of the antenna support structure are known, the components of the concealment assembly 100 can be fashioned. These components are then delivered to the site for assembly. One should note that in an alternative embodiment of the present invention, the entire concealment assembly 100 can be assembled off site and transported to the final resting place for placement on the roof's structural supports. In an exemplary embodiment of the present invention, the vertical support members 230, are arranged and positioned between each of the corresponding mounting platforms 140 and attached securely with self tapping screws. Once the vertical support member 230 skeleton is erected between top and bottom mounting platforms 230, pre-cut and routed horizontal support members 260 are attached. The horizontal support members 260 are individually spaced down and across the vertical support members 230 (based on the pre-engineered on-center requirements) from the top of assembly 100 to the bottom of the assembly 100), depending on the structural characteristics of the horizontal support member 260 as combined with the concealment panel 290.

Pre-drilled holes in the vertical support members 230 match up exactly with pre-drilled holes in the horizontal support members 260. As mentioned above, access holes drilled into the non-touching walls allow the RF transparent bolts and nuts to be tightened down, connecting the vertical support members 230 securely to the horizontal support members 260. These access holes are later hidden by the RF transparent panels 290.

After attaching each row of horizontal support members 260 to corresponding vertical support members 230, the completed concealment assembly 100 skeleton is now ready to accept RF transparent panels 290. RF transparent accessory trim is then used to frame the unit along the outer facing edges of the horizontal support members 260 and RF panel 290 junctures.

In one embodiment of the present invention, unique RF transparent nylon push pins 730 having a barbed edge are inserted into the panel 290 horizontal support member 260 combination to secure each panel 290 to corresponding horizontal support member 260. The push pins 730 secure the RF transparent panel 290 to the horizontal support members 260, and provide the concealment assembly 100 with additional engineered strength to meet rooftop wind loads.

The push pins 730 snap open inside the hollow horizontal support member 260 securely and structurally fastening the panel 290. This building process moves along horizontally as panels are inserted and connected to the previous panel, then vertically along each horizontal support member 260 until the concealment assembly unit 100 is completed.

Depending on the required concealment plan, an additional layer of the outdoor faux stone or brick digital vinyl wallpaper may be applied to the external sheathing in order to match the exact brick or stone pattern used on the original building.

In yet another embodiment of the present invention, a removable door panel (if applicable) is installed to permit access to the antenna and internal structure. In another embodiment of the present invention, the entire completed concealment assembly 100 can be shipped as a completed antenna concealment unit with steel frame, PVC skeleton, and panels attached.

While the invention has been particularly shown and described with reference to a preferred embodiment thereof, it will be understood by those skilled in the art that various other changes in the form and details may be made without departing from the spirit and scope of the invention. It should be understood that this description has been made by way of example, and that the invention is defined by the scope of the following claims.

I claim:

1. A system for visual concealment of radio frequency antennas, the system comprising:

at least two mounting platforms, wherein the at least two mounting platforms are coupled to a supporting structure according to a predetermined orientation;

at least two vertical structural members, wherein each of the at least two vertical structural members is fixable to at least one of the at least two mounting platforms, and wherein each of the at least two vertical structural members is comprised substantially of extruded polyvinyl chloride material of a wall thickness ranging from about 0.12 to about 0.27 inches having a hollow central region extending the length of the vertical structural member, and wherein each of the at least two vertical structural members possesses a plurality of prefabricated attachment points, and wherein the at least two vertical structural members are substantially transparent to radio frequencies ranging from about 3 kHz to about 300 GHz;

at least one horizontal structural member spanning between at least two of the at least two vertical structural members wherein the at least one horizontal structural member is supportably attached to at least two of the at least two vertical structural members via at least two of the plurality of prefabricated attachment points, and wherein the at least one horizontal structural member is comprised substantially of extruded polyvinyl chloride material with a wall thickness ranging from about 0.08 to about 0.1 inches having a hollow central region extending the length of the horizontal structural member, each of the horizontal structural members possessing a plurality of prefabricated attachment points, and wherein the horizontal structural members are substantially transparent to radio frequencies ranging from about 3 kHz to about 300 GHz;

a plurality of fasteners capable of supportably attaching the at least one horizontal structural member to the at least two vertical structural members at the prefabricated attachment points and wherein each fastener is substantially transparent to radio frequencies ranging from about 3 kHz to about 300 GHz; and at least one panel connected to the at least one horizontal structural member by a plurality of clasps at the prefabricated connecting points concealing the supporting structure, wherein the at least one panel is comprised of polyvinyl chloride material, and wherein the plurality of clasps and the at least one panel are substantially transparent to radio frequencies ranging from about 3 kHz to about 300 GHz.

2. The system of claim 1 wherein the supporting structure comprises a frame capable of housing at least one antenna.

3. The system of claim 1 wherein each of the at least two mounting platforms is configured to supportably receive at least one vertical structural member.

4. The system of claim 1 wherein the at least two vertical members are configured as box beams.

5. The system of claim 1 wherein the at least two vertical members are cylindrically shaped.

6. The system of claim 1 further comprising a second horizontal structural member spanning between at least two of the at least two vertical structural members in parallel with the at least one horizontal structural member.

7. The system of claim 1 wherein the at least one panel comprises a corrugated configuration having ventilation regions to mitigate surface forces due to wind impact.

8. The system of claim 1 wherein the vertical structural members, the horizontal structural members, and each panel are prefabricated according to the predetermined orientation of the supporting structure.

9. A method for concealing radio frequency antennas, the method comprising:

coupling at least two mounting platforms to a supporting structure according to a predetermined orientation;

fixing at least two vertical structural members to at least one of the at least two mounting platforms wherein each vertical structural member is comprised of polyvinyl chloride material having a hollow central region extending the length of the vertical structural member, and wherein each of the at least two vertical structural members possesses a plurality of prefabricated attachment points and is substantially transparent to radio frequencies ranging from about 3 kHz to about 300 GHz;

spanning at least one horizontal structural member between at least two of the at least two vertical structural members wherein the at least one horizontal structural member is supportably attached to at least two of the at least two vertical structural members via at least two of the plurality of prefabricated attachment points, and wherein the at least one horizontal structural member comprises a plurality of prefabricated connecting points, and wherein the at least one horizontal structural member is comprised of polyvinyl chloride material that is substantially transparent to radio frequencies ranging from about 3 kHz to about 300 GHz; and connecting at least one panel to the at least one horizontal structural member by a plurality of clasps via the prefabricated connecting points concealing the supporting structure, wherein the at least one panel is comprised of polyvinyl chloride material, and wherein the plurality of clasps and the at least one panel are substantially transparent to radio frequencies ranging from about 3 kHz to about 300 GHz.

10. The method of claim 9 wherein the supporting structure comprises a frame capable of housing at least one antenna.

11. The method of claim 9 wherein each of the at least two mounting platforms is configured to supportably receive at least one vertical structural member.

12. The method of claim 9 wherein the at least one vertical member is configured as a box beam.

13. The method of claim 9 wherein the at least one vertical member is cylindrically shaped.

14. The method of claim 9 further comprising spanning a second horizontal structural member between at least two vertical structural members in parallel with the at least one horizontal structural member.

15. The method of claim 10 wherein the at least one panel comprises a corrugated configuration having ventilation regions to mitigate surface forces due to wind impact.

16. The method of claim 9 wherein the vertical structural members, the horizontal structural members, and each panel are prefabricated according to the predetermined orientation of the supporting structure.

17. An antenna concealment assembly, the assembly comprising:

at least two mounting platforms coupled to an antenna supporting structure;

at least two vertical polyvinyl chloride structural members, wherein each of the at least two vertical structural members is fixable to at least one of the at least two mounting platforms and includes a plurality of prefabricated attachment points;

at least one horizontal polyvinyl chloride structural member spanning between the at least two vertical polyvinyl chloride structural members wherein the at least one horizontal polyvinyl chloride structural member is attached to the at least two vertical polyvinyl chloride structural members by radio frequency transparent fasteners via at least two of the plurality of prefabricated attachment points; and at least one polyvinyl chloride panel connected to the at least one horizontal structural member by a plurality of radio frequency transparent clasps at a plurality of prefabricated connecting points concealing the antenna supporting structure.

18. The assembly of claim 17 wherein the at least two vertical polyvinyl chloride structural members, at least one horizontal polyvinyl chloride structural member, and the at least one polyvinyl chloride panel are prefabricated according to a predetermined orientation of the antenna supporting structure.

19. The assembly of claim 17 wherein the polyvinyl chloride material is substantially transparent to radio frequencies ranging from about 3 kHz to about 300 GHz.

20. A method of using a polyvinyl chloride material to conceal radio frequency ("RF") antennas and permit RF transparency of RF signals, comprising the steps of:

coupling at least two mounting platforms to a supporting structure;

fixing at least two vertical structural members to at least one of the at least two mounting platforms wherein each vertical structural member is comprised of polyvinyl chloride material having a hollow central region extending the length of the vertical structural member, and wherein each of the at least two vertical structural members possesses a plurality of prefabricated attachment points and is substantially transparent to radio frequencies;

spanning at least one horizontal structural member between at least two of the at least two vertical structural members wherein the at least one horizontal structural member is attached to at least two of the at least two vertical structural members via at least two of the plurality of prefabricated attachment points, and wherein the at least one horizontal structural member comprises a plurality of prefabricated connecting points, and wherein the at least one horizontal structural member is comprised of polyvinyl chloride material that is substantially transparent to radio frequencies; and connecting at least one panel to the at least one horizontal structural member at the prefabricated connecting points concealing the supporting structure, wherein the at least one panel is comprised of polyvinyl chloride material.

21. The method of claim 20 wherein the supporting structure comprises a frame capable of housing at least one antenna.

22. The method of claim 20 wherein each of the at least two mounting platforms is configured to supportably receive at least one vertical structural member.

23. The method of claim 20 wherein the at least one vertical member is configured as a box beam.

24. The method of claim 20 wherein the at least one vertical member is cylindrically shaped.

25. The method of claim 20 further comprising spanning a second horizontal structural member between at least two vertical structural members in parallel with the at least one horizontal structural member.

26. The method of claim 20 wherein the at least one panel is substantially transparent to radio frequencies ranging from about 3 kHz to about 300 GHz.

27. An antenna concealment kit, the kit comprising:

at least two mounting platforms coupled to an antenna supporting structure;

at least two vertical polyvinyl chloride structural members, wherein each of the at least two vertical structural members is fixable to at least one of the at least two mounting platforms;

at least one horizontal polyvinyl chloride structural member capable of spanning between the at least two vertical polyvinyl chloride structural members;

a plurality of radio frequency transparent fasteners capable of attaching the at least two vertical structural members to the at least one horizontal polyvinyl chloride structural member;

at least one polyvinyl chloride panel capable of being connected to the at least one horizontal structural member; and a plurality of radio frequency transparent clasps capable of attaching the at least one polyvinyl chloride panel at prefabricated connecting points to substantially conceal the antenna supporting structure.

* * * * *